United States Patent [19]

Hacker, Jr.

[11] 4,090,542

[45] May 23, 1978

[54] FOLDABLE TOTE BAG

[76] Inventor: Walter L. Hacker, Jr., 2221 Patty La., Green Bay, Wis. 54304

[21] Appl. No.: 721,401

[22] Filed: Sep. 8, 1976

[51] Int. Cl.[2] ..... A45C 7/00

[52] U.S. Cl. ..... 150/1.7; 190/43; 190/52

[58] Field of Search ..... 150/1.7, 7, 28 R, 33, 150/46, 49; 190/43, 52

[56] References Cited

U.S. PATENT DOCUMENTS

| | | | |
|---|---|---|---|
| 1,666,704 | 4/1928 | Hunter | 150/1.7 |
| 2,680,460 | 6/1954 | Hyman | 190/52 X |
| 3,122,225 | 2/1964 | Ward | 190/52 |

FOREIGN PATENT DOCUMENTS

| | | | |
|---|---|---|---|
| 717,791 | 10/1931 | France | 150/1.7 |

*Primary Examiner*—Donald F. Norton

[57] ABSTRACT

A tote bag may be folded from an article-receiving position to a collapsed position and includes a receptacle which has four longitudinal walls and first and second open ends. First and second covers may be attached to opposite ends of the walls, and the first and second ends may be closed by the first and second covers, respectively. Reinforcement means pivotably attached to one of the walls are provided for holding the bag in the article-receiving position.

5 Claims, 3 Drawing Figures

FOLDABLE TOTE BAG

BACKGROUND OF THE INVENTION

Field of the Invention

The field of the present invention relates to a foldable tote bag.

SUMMARY OF THE INVENTION

It is accordingly an object of the present invention to devise a foldable tote bag which, upon being folded, occupies a relatively small space.

I accordingly provide a tote bag which is foldable from an article receiving position to a collapsed position, and which includes a receptacle which has four longitudinal walls and first and second open ends. First and second covers are hingeably attached to opposite ends of one of the walls, and the first and second ends may be closed by the first and second covers, respectively. Fastening means are attached to the wall disposed opposite to the one of the walls, and fastened to the first and second covers, respectively, for fastening the first and second covers to the wall disposed opposite to the one wall. The walls joining one of the walls, and the wall disposed opposite to the latter are foldable along longitudinal axes, respectively, each of the axes being disposed substantially midway on each of the joining walls, respectively. Reinforcement means are pivotably attachable to the one of the walls, and include attachment means for attaching the reinforcement means to the wall disposed opposite to the one of the walls in the article-receiving position. The reinforcement means may be collapsed into a position disposed substantially along the one of the walls. A second tote bag which has smaller longitudinal dimensions than the first tote bag, but is otherwise similar thereto, and wherein one wall of the walls of the second tote bag is attachable to the one of the walls of the first tote bag, the second covers of the tote bags being substantially in the same plane in the article-receiving positions of the tote bags, may be attached to the first tote bag, and wherein the folded tote bags may be further folded about lines transverse to the axes and in a plane parallel to the one of the walls. The first cover of the first tote bag is preferably formed with a recess. A handle is attached with a first end thereof to the wall disposed opposite the one wall of the first tote bag, and with the second end thereof to the wall disposed opposite the one wall of the second tote bag. At least one of the tote bags includes a foldable pocket attached to one of the joining walls.

BRIEF DESCRIPTION OF THE DRAWING

My invention will be better understood by means of the accompanying drawing in which.

DETAILED DESCRIPTION OF THE PREFERRED EMBODIMENT

Figure 1:
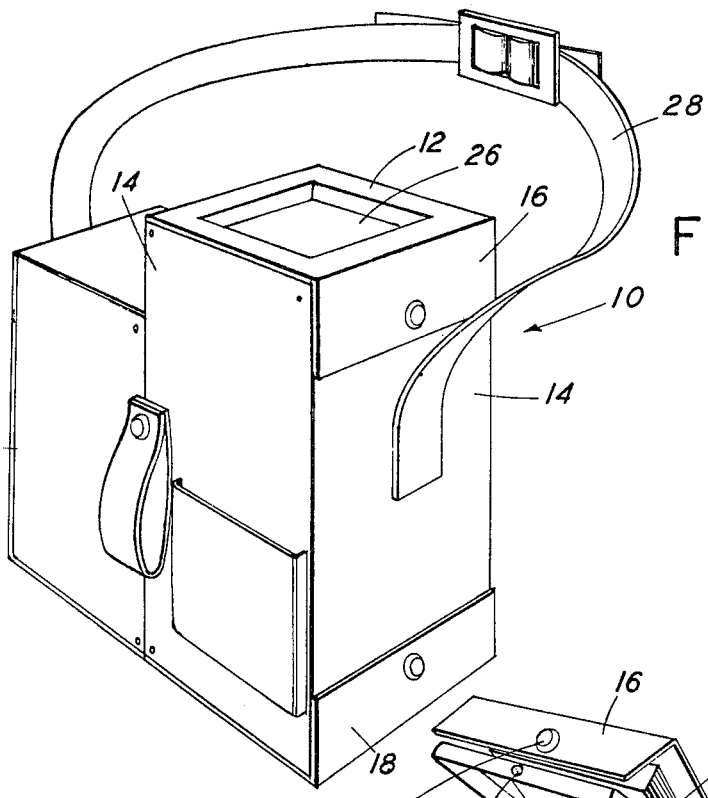
FIG. 1 shows a perspective view of the tote bag, according to my invention.
Figure 3:
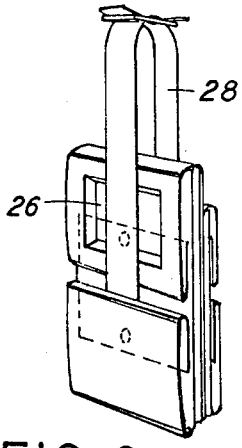
FIG. 3 shows the tote bag in a collapsed position.
Figure 2:
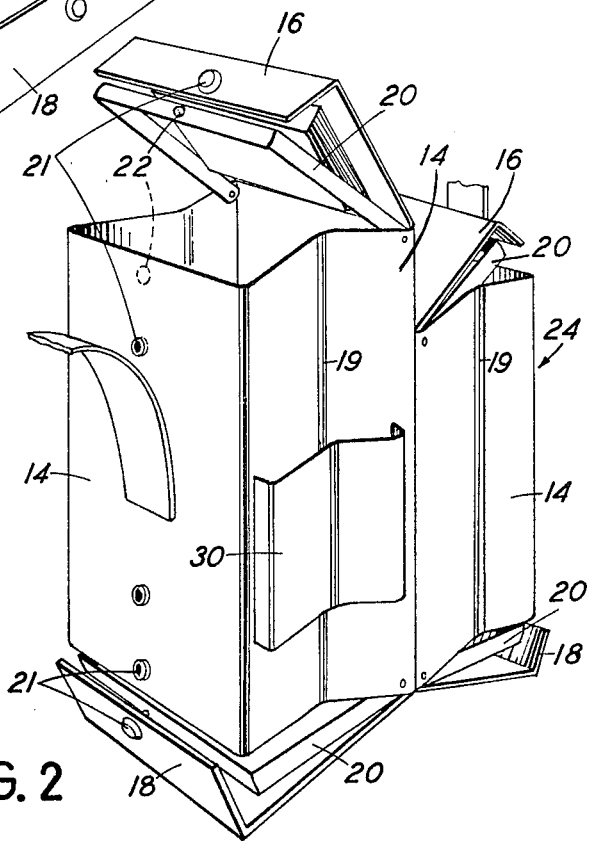
FIG. 2 shows another perspective view of the tote bag with the covers partially open.

Referring now to the drawing, a tote bag 10 is foldable from an article-receiving position to a collapsed position, and includes a receptacle 12 which has four longitudinal walls 14, 14', 14'', 14''' and first and second open ends. A cover 16 and another cover 18 are hingeably attached to opposite ends of the wall 14''; the first and second ends may be closed by the covers, 16 and 18, respectively. Fastening means 21 in the form of, for example, snap-on button means are attached to the wall 14, and are also fastened to the covers 16 and 18, respectively, for fastening the covers 16 and 18 to the wall 14''. The walls 14' and 14''' may be folded along longitudinal axes 19, respectively, each axis 19 being disposed substantially midway on each of the walls 14' and 14''' respectively. Reinforcement means 20 may be pivotably attached, for example, to the wall 14'', and include attachment means 22 for attaching the reinforcement means 20 to the wall 14''. The reinforcement means 20 are collapsible into a position disposed substantially along the wall 14''. A second tote bag 24 has smaller longitudinal dimensions than the first tote bag 10, but is otherwise similar thereto. A wall 15' of the second tote bag 24 is attached to the wall 14'' of the first tote bag, and the second covers 18 of the tote bags 10 and 24 are substantially in the same plane in the article-receiving positions of the tote bags 10, and 24. The covers 16 and 18 are hingeably attached to the folded tote bags 10 and 24 may be further folded about lines 23 and 25, respectively, which are transverse to the axes 19 and in a plane parallel to the wall 14. The cover 16 of the tote bag 10 is preferably formed with a recess 26 for holding an article, such as a cup, therein. A handle 28 has first and second ends, and the first end thereof may be attached to the wall 14; the second end thereof may be attached to the wall 15''' of the second tote bag 24. At least one of the tote bags 10 and 24 includes a foldable pocket 30 attached to one of the joining walls thereof.

Although the invention has been described with respect to a preferred version thereof, it is to be understood that it is not to be so limited since changes can be made therein which are within the full intended scope of the appended claims.

I claim:

1. A tote bag foldable from an article-receiving position to a collapsed position comprising:

a receptacle having four longitudinal walls and having first and second open ends;

first and second covers hingeably attached to opposite ends of one of said walls, said first and second ends being closable by said first and second covers, respectively;

fastening means attached to the wall disposed opposite to said one of said walls and fastened to said first and second covers, respectively, for fastening said first and second covers to said wall disposed opposite to said one wall, and wherein the walls joining said one of said walls are foldable along longitudinal axes, respectively, each of said axes being disposed substantially midway on each of the joining walls, respectively;

reinforcement means pivotably attached to said one of said walls, and including attachment means for attaching said reinforcement means to said wall disposed opposite to said one of said walls in said article-receiving position, said reinforcement means being collapsible into a position disposed substantially along said one of said walls.

2. A tote bag according to claim 1 further comprising a second tote bag having smaller longitudinal dimensions than said first tote bag, but otherwise similar thereto, one of the walls of said second tote bag being attached to said one of said walls of said first tote bag, the second covers of said tote bags being substantially in the same plane in the article-receiving positions of said tote bags, and wherein said covers are further foldable about lines transverse to said axes and in a plane parallel to said one of said walls.

3. A tote bag according to claim 1 wherein said first cover is formed with a recess.

4. A tote bag according to claim 2 further comprising a handle having first and second ends, the first end thereof being attachable to said wall disposed opposite said one of said walls of said first tote bag, the second end thereof being attachable to the wall disposed opposite said one of said walls of said second tote bag.

5. A tote bag according to claim 3 including a foldable pocket attached to one of the joining walls thereof.

* * * * *